US005613276A

United States Patent [19]

Franz

[11] Patent Number: 5,613,276

[45] Date of Patent: Mar. 25, 1997

[54] GLASS SHOWER DOOR HINGE SYSTEM AND METHOD

[76] Inventor: George W. Franz, 26 Dogwood La., Trumbull, Conn. 06611

[21] Appl. No.: 575,227

[22] Filed: Dec. 20, 1995

[51] Int. Cl.[6] ..... E05D 7/10; E05F 1/02

[52] U.S. Cl. ..... 16/229; 16/309; 16/315; 49/397

[58] Field of Search ..... 16/229, 230, 231, 16/280, 284, 312, 315, 309; 160/199, 196.1, 206, 213; 49/397, 399, 381

[56] References Cited

U.S. PATENT DOCUMENTS

| | | | |
|---|---|---|---|
| 1,318,824 | 10/1919 | Alary | 16/315 |
| 1,386,621 | 8/1921 | Hughes | 16/284 |
| 3,246,684 | 4/1966 | Rudnick | 160/213 |
| 3,398,487 | 8/1968 | Matyas | 16/312 |
| 3,410,026 | 11/1968 | Casebolt | 49/397 |
| 4,799,529 | 1/1989 | McAfee | 160/206 |
| 5,205,072 | 4/1993 | Eutebach | 49/381 |

*Primary Examiner*—Chuck Y. Mah
*Attorney, Agent, or Firm*—John H. Crozier

[57] ABSTRACT

In a preferred embodiment, a glass door hinge system for attachment of a glass door to a frame, the system including: an upper hinge member having an upper clamping member for attachment to an upper horizontal edge of the glass door and having an upper base member for attachment to the frame, the upper clamping member being rotatably attachable to the upper base member; and a lower hinge member having a lower clamping member for attachment to a lower horizontal edge of the glass door and having an lower base member for attachment to the frame, the lower clamping member being rotatably attachable to the lower base member.

10 Claims, 5 Drawing Sheets

GLASS SHOWER DOOR HINGE SYSTEM AND METHOD

SUMMARY OF THE INVENTION

The present invention achieves the above objects, among others, by providing, in a preferred embodiment, a glass door hinge system for attachment of a glass door to a frame, said system comprising: an upper hinge member having an upper clamping member for attachment to an upper horizontal edge of said glass door and having an upper base member for attachment to said frame, said upper clamping member being rotatably attachable to said upper base member; and a lower hinge member having a lower clamping member for attachment to a lower horizontal edge of said glass door and having an lower base member for attachment to said frame, said lower clamping member being rotatably attachable to said lower base member.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
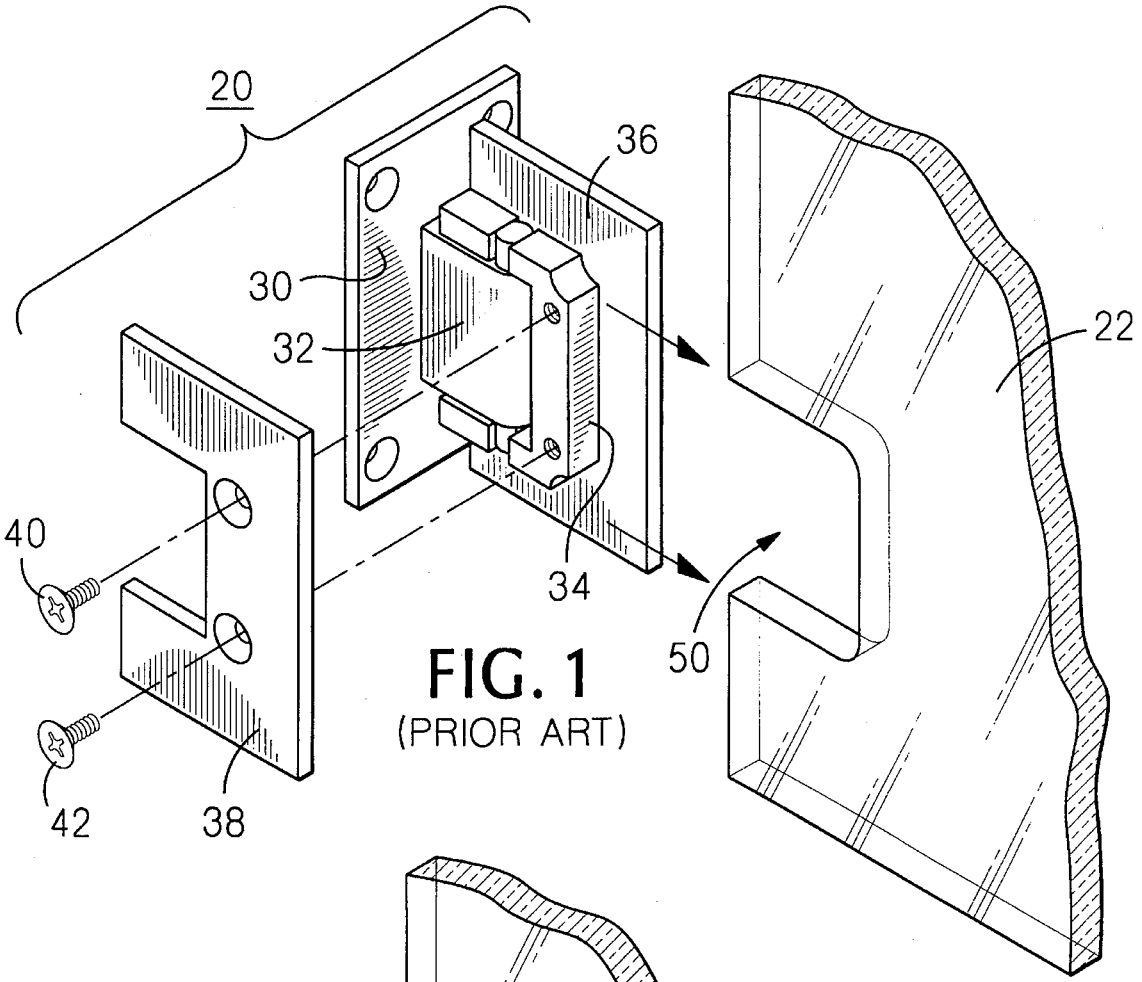
FIG. 1 (PRIOR ART)
FIG. 1 is an exploded isometric view showing a conventional glass shower door hinge being installed on a glass shower door.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a conventional glass shower door hinge, generally indicated by the reference numeral 20, being attached to a glass shower door 22. Hinge 20 includes a mounting plate 30 for attachment to a door frame (not shown) and a spring mechanism 32 fixedly attached to the mounting plate, the spring mechanism including a vertical yoke 34 rotatably attached thereto. A first vertical clamping flange 36 is integral with, or fixedly attached to, yoke 34 and a second vertical clamping flange 38 is attachable to the yoke by means of screws 40 and 42.

Figure 2:
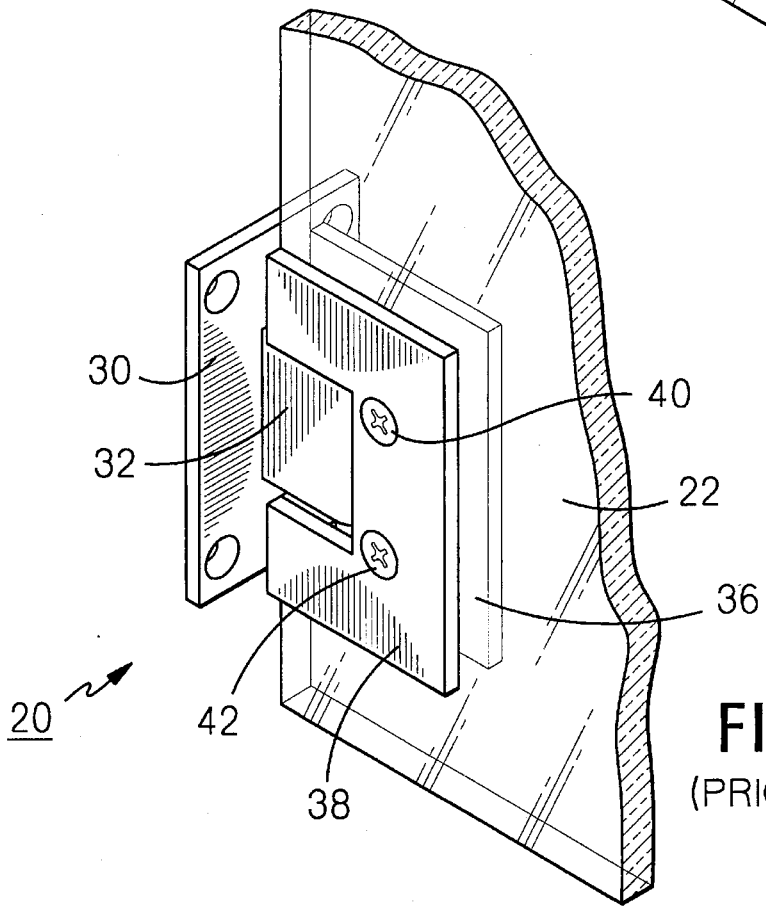
FIG. 2 (PRIOR ART)
FIG. 2 is an isometric view showing the conventional hinge installed on a glass shower door.

To install hinge 20 on door 22, a rectilinear notch 50 is cut in the edge of door 22 to fit around spring mechanism 32, the edge of the door is inserted over the spring mechanism, and second vertical clamping flange is screwed to the spring mechanism to clamp the hinge in place on the door. Hinge 20 is shown attached near the lower edge of door 22. It will be understood that a similar hinge (not shown) will be attached near the upper edge of door 22 and that first and second vertical clamping flanges and the door will rotate about spring mechanism 32. Spring mechanism 32 is constructed such that the "rest" position of door 22 is as shown on FIG. 2, with the door being disposed orthogonally to mounting flange 30.

It will be understood that hinge 20 is relatively expensive in itself and is relatively expensive to install, since a cut must be made in the edge of door 22.

Figure 8:
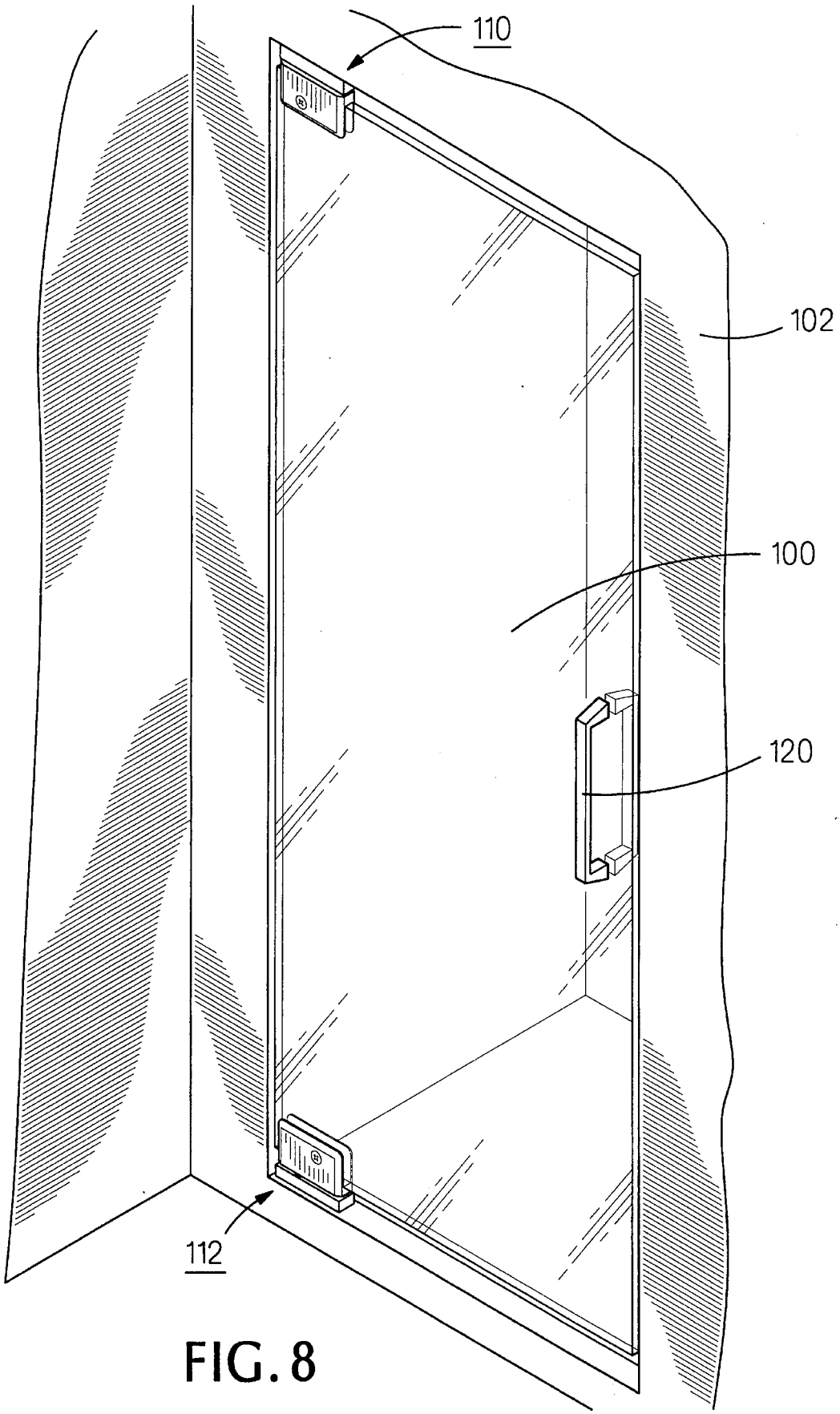
FIG. 8 is an isometric view of a shower installation with a glass door employing the hinge system of the invention.

Referring now to FIG. 8, there is illustrated a glass shower door 100 mounted in a shower stall frame 102 by means of the hinge system of the present invention, the hinge system including upper and lower hinge members, generally indicated by the reference numerals 110 and 112, attached, respectively, to the upper and lower horizontal edges of the door. It will be understood that door 100 may be pivotally opened inwardly, as indicated by the arrow, by suitable pressure applied to one side or the other of double handle 120 attached to the door.

Figure 3:
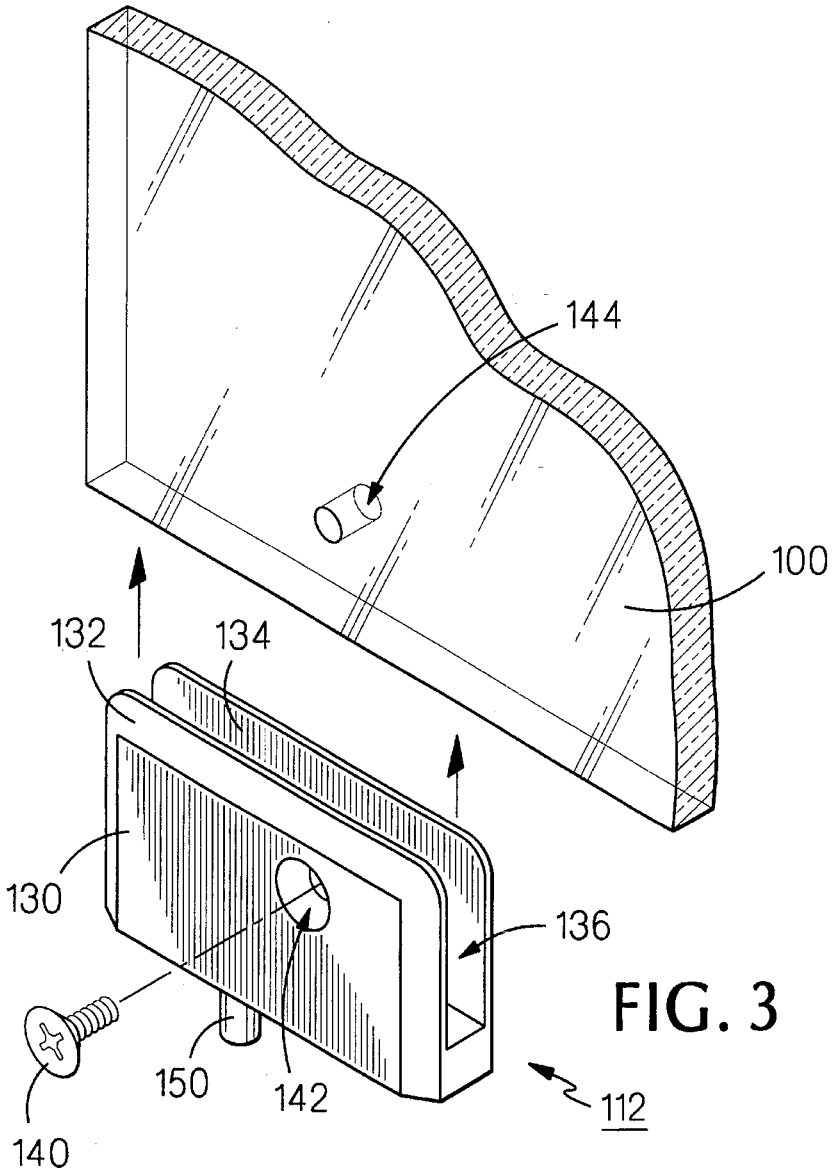
FIG. 3 is an isometric view showing a lower clamping member of a hinge constructed according to the present invention being attached to a glass shower door.
Figure 4:
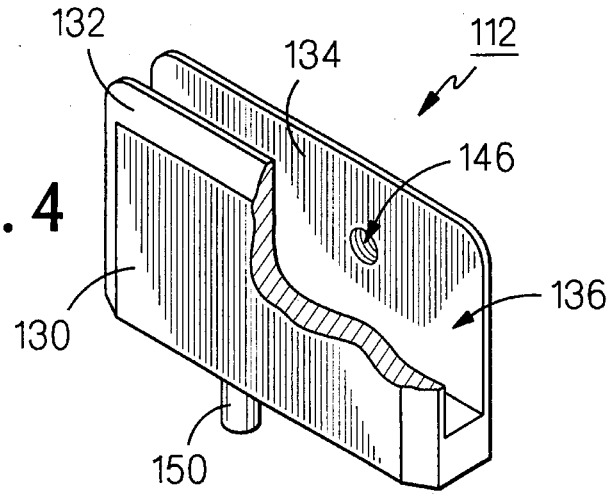
FIG. 4 is an isometric view, partially cut-away, of the lower clamping member of FIG. 3.

FIGS. 3 and 4 illustrate details of lower hinge member 112 and the method of attachment thereof to door 100. Lower hinge member 112 includes a lower clamping member 130 in an upwardly open U-shaped form having spaced apart, first and second, parallel, vertical walls 132 and 134 which define therebetween an elongate channel 136 dimensioned to accept therein the lower edge of door 100 (FIG. 3). The lower edge of door 100 is secured within channel 136 by means of a screw 140 (FIG. 3) extending through a hole 142 defined through first vertical wall 132, through a relatively easily drilled hole 144 defined through the door, and threadedly inserted into a hole 146 (FIG. 4) defined in second vertical wall 134. A cylindrical pivot pin 150 depends vertically from a lower portion of lower clamping member 130.

Figure 5:
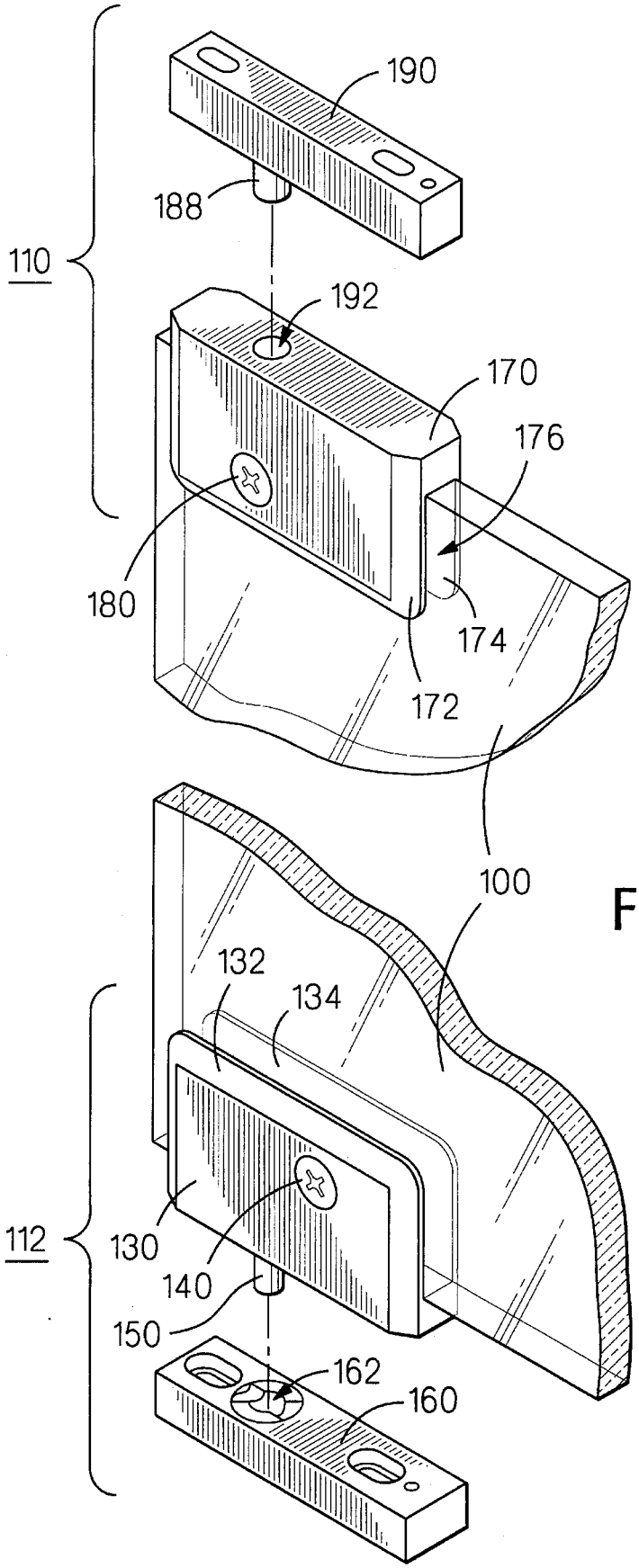
FIG. 5 is an isometric view showing upper and lower clamping members of the invention attached to a glass shower door, with upper and lower base members in exploded relationship to the upper and lower clamping members.

FIG. 5 illustrates lower clamping member 130 installed on the lower edge of door 100 and also shows the relationship of the lower clamping member to a lower base member 160 which forms part of lower hinge member 112. It can be seen that lower base member 160 includes a vertical cylindrical opening defined therein to rotatingly accept therein pivot pin 150.

FIG. 5 also illustrates upper hinge member 110 having an upper clamping member 170 in an downwardly open U-shaped form having spaced apart, first and second, parallel, vertical walls 172 and 174 which define therebetween an elongate channel 176 dimensioned to accept therein the upper edge of door 100. The upper edge of door 100 is secured within channel 176 by means of a screw 180 in the same manner as screw 140 in lower clamping member 112. A cylindrical pivot pin 188 is fixedly attached to and depends vertically from a lower portion of an upper base member 190 which forms part of upper hinge member 110. Pivot pin is rotatingly insertable in a cylindrical opening defined in the upper portion of upper clamping member 170.

With the elements of upper and lower hinge members 110 and 112 so arranged, it will be understood that, with upper and lower base members 190 and 160 fixedly attached to shower stall frame 102 (FIG. 8), door 100 may pivotally open and close by means of pivot pin 188 rotatingly engaging hole 192 and pivot pin 150 rotatingly engaging hole 162.

Figure 6:
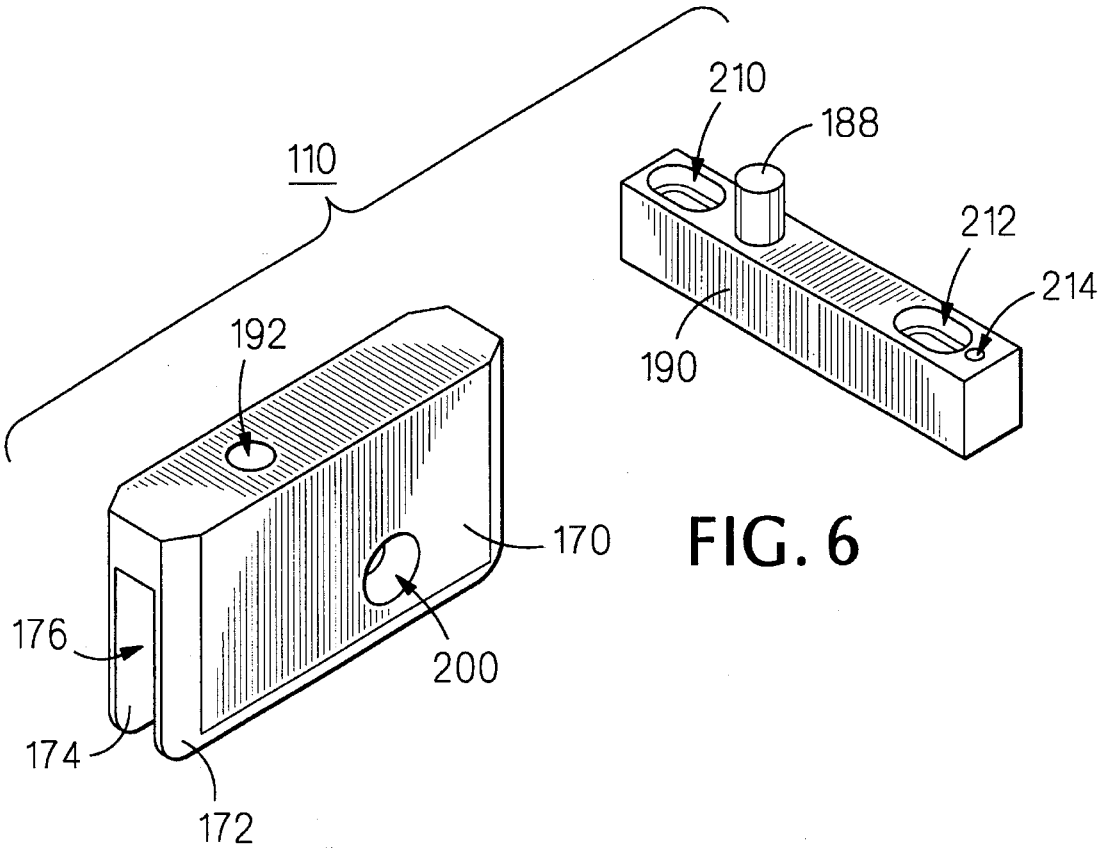
FIG. 6 is an isometric view of the elements of the upper hinge member of the invention.

FIG. 6 illustrates the elements of upper hinge member 110 described above and also shows a hole 200 defined through first vertical wall 172 of upper hinge member 170 for the insertion therein of screw 180 (FIG. 5). Upper base member 190 includes openings 210 and 212 defined therethrough to accept fasteners (not shown) for the attachment of the upper base member to shower stall frame 102 (FIG. 8). A pilot hole 214 is also defined through upper base member 190 for the accurate locating of the upper base member on frame 102.

Figure 7:
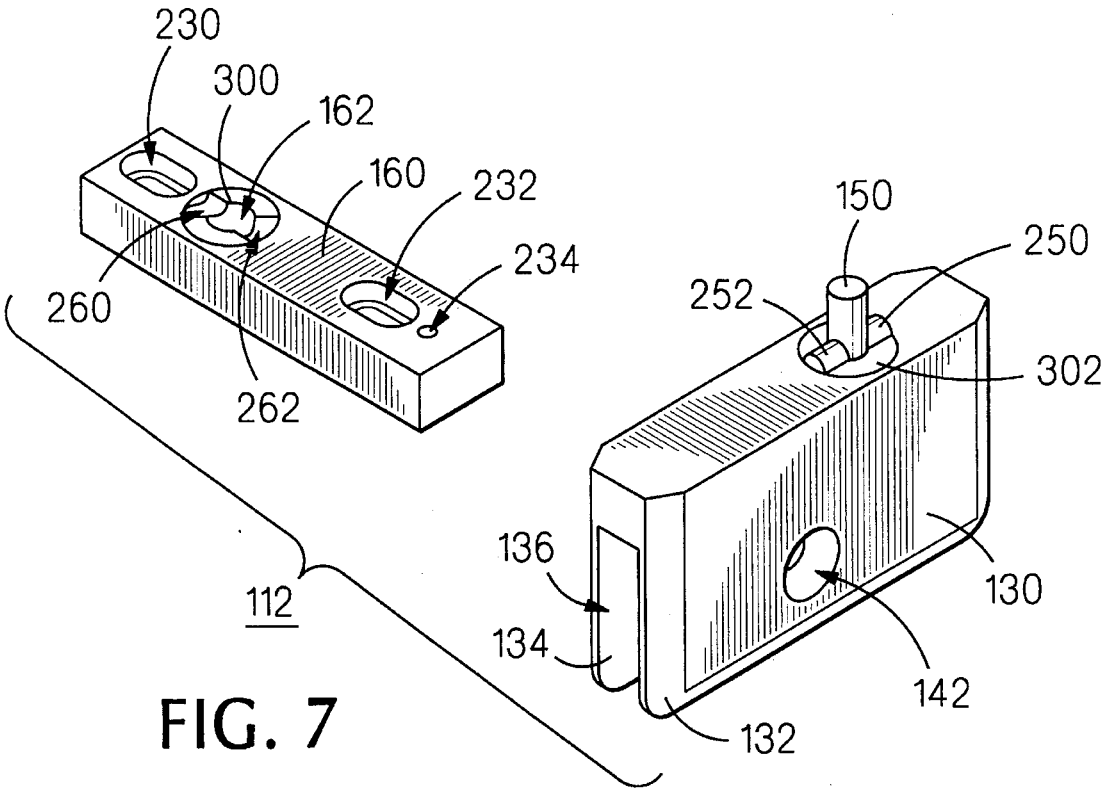
FIG. 7 is an isometric view of the elements of the lower hinge member of the invention.

FIG. 7 illustrates the elements of lower hinge member 112 described above and also shows openings 230 and 232 defined through lower base member 160 to accept fasteners (not shown) for the attachment of the lower base member to shower stall frame 102 (FIG. 8). A pilot hole 234 is also defined through lower base member 160 for the accurate locating of the lower base member on frame 102. Lower hinge member 112 also includes a detent mechanism comprising two hemicylindrical protrusions 250 and 252 extending axially from the base of pivot pin 150, the protrusions engaging, respectively, complementarily shaped depressions 260 and 262 defined axially of hole 162, when door 100 is centered in frame 102 as is shown on FIG. 8. Depressions 260 and 262 are shaped such as to prevent door 100 from being opened outwardly. When door 100 is manually opened inwardly, protrusions 250 and 252 rise upwardly in depressions 260 and 262, thus raising the door and providing an unbalanced condition to cause the door to swing shut to a centered position when the door is manually released.

Upper and lower clamping members 170 and 130 and upper and lower base members 190 and 160 are preferably constructed of brass. Pivot pin 188 (FIG. 6) is preferably constructed of stainless steel. Hole 162 and depressions 260 and 262 (FIG. 7) are preferably formed in a cylindrical bronze insert 300 fixedly attached to lower base member 160, while pivot pin 150 and protrusions 250 and 252 are preferably formed in a cylindrical, stainless steel insert 302 fixedly attached to lower clamping member 130.

The hinge system of the present invention is easily installed and requires only the drilling of two holes through door 100 and the drilling of mounting holes in frame 102 (FIG. 8).

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A glass door hinge system for attachment of a glass door to a frame, said system comprising:

(a) an upper hinge member having an upper clamping member for attachment to an upper horizontal edge of said glass door and having an upper base member for attachment to said frame, said upper clamping member being rotatably attachable to said upper base member;

(b) a lower hinge member having a lower clamping member for attachment to a lower horizontal edge of said glass door and having an lower base member for attachment to said frame, said lower clamping member being rotatably attachable to said lower base member;

(c) said lower clamping member having a raised portion depending from a lower surface of said lower clamping member; and (d) said lower base member having a horizontal surface with a depression formed therein;

whereby, engagement of said raised portion and said depression tends to cause said door to close and to rest in a centered position within said frame when said door is near a closed position, but engagement of said raised portion and said horizontal surface permits said door to remain in a selected one of a number of stationary open positions.

2. A glass door hinge system, as defined in claim 1, wherein:

(a) said upper clamping member is a downwardly open U-shaped form having spaced apart, first and second, parallel, vertical walls defining therebetween an upper elongate channel dimensioned to accept therein said upper edge of said glass door; and (b) said lower clamping member is an upwardly open U-shaped form having spaced apart, first and second, parallel, vertical walls defining therebetween a lower elongate channel dimensioned to accept therein said lower edge of said door.

3. A glass door hinge system, as defined in claim 2, wherein: said upper and lower clamping members are attachable, respectively, to said upper and lower edges of said glass door by means of fasteners extending through said glass door between respective said first and second vertical walls.

4. A glass door hinge system, as defined in claim 1, wherein:

(a) said upper clamping member is rotatably attachable to said upper base member by means of an upper pivot pin extending from one of said upper clamping member and said upper base member and inserted into an upper hole defined in the other of said upper clamping member and said upper base member; and (b) said lower clamping member is rotatably attachable to said lower base member by means of a lower pivot pin extending from one of said lower clamping member and said lower base member and inserted into a lower hole defined in the other of said lower clamping member and said lower base member.

5. A glass door hinge system, as defined in claim 1, wherein: said depression is shaped such as to permit said door to be easily opened in one direction, but to resist said door to be opened in an opposite direction.

6. A method of installing a glass shower door in a frame using a hinge system, said method comprising:

(a) providing an upper hinge member having an upper clamping member for attachment to an upper horizontal edge of said glass door and having an upper base member for attachment to said frame, said upper clamping member being rotatably attachable to said upper base member;

(b) providing a lower hinge member having a lower clamping member for attachment to a lower horizontal edge of said glass door and having an lower base member for attachment to said frame, said lower clamping member being rotatably attachable to said lower base member, said lower clamping member having a raised portion depending from a lower surface of said lower clamping member, and said lower base member having a horizontal surface with a depression formed centrally thereof and extending partially along an axis of said lower base member parallel to said glass door, whereby, engagement of said raised portion and said depression tends to cause said door to close and to rest in a centered position within said frame when said door is near a closed position, but engagement of said raised portion and said horizontal surface permits said door to remain in a stationary open position;

(c) attaching said upper clamping member to said upper horizontal edge and attaching said lower clamping member to said lower horizontal edge;

(d) attaching said upper clamping member to said upper base member and attaching said lower clamping member to said lower base member; and (e) attaching said upper base member and said lower base member to said frame.

7. A method, as defined in claim 6, further comprising:

(a) providing said upper clamping member as a downwardly open U-shaped form having spaced apart, first and second, parallel, vertical walls defining therebetween an upper elongate channel dimensioned to accept therein said upper edge of said glass door; and (b) providing said lower clamping member as an upwardly open U-shaped form having spaced apart, first and second, parallel, vertical walls defining therebetween a lower elongate channel dimensioned to accept therein said lower edge of said door.

8. A method, as defined in claim 7, further comprising: providing said upper and lower clamping members for attachment, respectively, to said upper and lower edges of said glass door by means of fasteners extending through said glass door between respective said first and second vertical walls.

9. A method, as defined in claim 6, further comprising:

(a) providing said upper clamping member rotatably attachable to said upper base member by means of an upper pivot pin extending from one of said upper clamping member and said upper base member and inserted into an upper hole defined in the other of said upper clamping member and said upper base member; and (b) providing said lower clamping member rotatably attachable to said lower base member by means of a lower pivot pin extending from one of said lower clamping member and said lower base member and inserted into a lower hole defined in the other of said lower clamping member and said lower base member.

10. A method, as defined in claim 6, further comprising: providing said depression shaped such as to permit said door to be easily opened in one direction, but to resist said door to be opened in an opposite direction.

* * * * *